US006600304B2

(12) United States Patent
Kim

(10) Patent No.: US 6,600,304 B2
(45) Date of Patent: Jul. 29, 2003

(54) CURRENT GENERATING CIRCUIT INSENSIVE TO RESISTANCE VARIATION

(75) Inventor: Nam-Keal Kim, Kyunggi-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/998,147

(22) Filed: Nov. 30, 2001

(65) Prior Publication Data

US 2002/0113583 A1 Aug. 22, 2002

(30) Foreign Application Priority Data

Feb. 22, 2001 (KR) ..... 2001-9028

(51) Int. Cl.[7] ..... G05F 3/16
(52) U.S. Cl. ..... 323/315; 323/313
(58) Field of Search ..... 323/315, 314, 323/313, 312, 316, 907; 327/530, 534, 538, 535

(56) References Cited

U.S. PATENT DOCUMENTS 5,629,611 A 5/1997 McIntyre ..... 323/313
5,629,614 A 5/1997 Choe et al. ..... 323/315
5,783,936 A * 7/1998 Girad et al. ..... 323/315
6,087,820 A 7/2000 Houghton et al. ..... 323/315

* cited by examiner

*Primary Examiner*—Rajnikant B. Patel
(74) *Attorney, Agent, or Firm*—Mills & Onello LLP

(57) ABSTRACT

A current generating circuit includes a first resistance inversely proportional current generator, a second resistance inversely proportional current generator, and a current subtractor. The first resistance inversely proportional current generator has a first resistance element, and generates a first current which is inversely proportional to resistance variation of the first resistance element. The second resistance inversely proportional current generator has second and third resistance elements of the same type as the first resistance element, and generates a second current which is inversely proportional to half of the resistance variation. The current subtractor subtracts the first current from the second current to output a constant current regardless of the resistance variation of the first to third resistance elements.

8 Claims, 4 Drawing Sheets

CURRENT GENERATING CIRCUIT INSENSIVE TO RESISTANCE VARIATION

RELATED APPLICATION

This application relies for priority upon Korean Patent Application No. 2001-09028, filed on Feb. 22, 2001, the contents of which are herein incorporated by reference in their entirety.

FIELD OF THE INVENTION

The present invention generally relates to a current generating circuit and, more particularly, to a current generating circuit (or constant current generating circuit) that generates a constant current using a bandgap reference circuit, regardless of resistance variation.

BACKGROUND OF THE INVENTION

In a semiconductor circuit and a semiconductor memory device, a constant current generating circuit is applied to various portions. Such a constant current generating circuit is used to generate a constant current, or is employed as a current supply for a differential amplifier circuit or as a high-resistance transistor load, commonly referred to as an "active load". For example, such a constant current generating circuit is used in a voltage-down converter in a memory device, or is used in an analog circuit such as a delay-locked loop (DLL) to shorten memory access time. Such a constant current generating circuit can be made of a bandgap reference circuit, an operational amplifier, transistors, and a resistance. Also, such a constant current generating circuit is disclosed in U.S. Pat. No. 5,519,309 entitled "VOLTAGE TO CURRENT CONVERTER WITH EXTENDED DYNAMIC RANGE", U.S. Pat. No. 5,629,614 entitled "VOLTAGE-TO-CURRENT CONVERTER", and U.S. Pat. No. 6,087,820 entitled "CURRENT SOURCE".

Referring now to FIG. 1, a current generating circuit 1 acts as a voltage-to-current converter using a bandgap reference circuit. The current generating circuit 1 includes a bandgap reference circuit 10, an operational amplifier 20, two PMOS transistors M2 and M3, three NMOS transistors M1, M4, and M5, and a resistance R1. A current mirror is structured by the PMOS transistors M2 and M3, and another current mirror is structured by the NMOS transistors M4 and M5. The transistors M1–M5 operate in a saturated region. The resistance R1 is created using an N or P-type active region or polysilicon. Examples of the bandgap reference circuit shown in FIG. 1 are disclosed in U.S. Pat. No. 5,629,611 entitled "CURRENT GENERATOR CIRCUIT FOR GENERATING SUBSTANTIALLY CONSTANT CURRENT" and U.S. Pat. No. 6,087,820 entitled "CURRENT SOURCE".

Under the assumption that the operational amplifier 20 is ideal, an inversion terminal negative voltage of the operational amplifier 20 is identical to a non-inversion terminal positive voltage, i.e., a constant voltage Vbgr that is outputted from the bandgap reference circuit 10. A current I1 flowing to the resistance R1 is determined by the following equation <Equation 1>.

$$I1=V_{bgr}/R_1 \qquad \text{<Equation 1>}$$

The current I1 also flows through the PMOS transistor M3 constituting a current mirror, and through the NMOS transistors M4 and M5 constituting another current mirror.

Finally, this makes it possible to obtain a required current Iout. Since the current Iout is proportional to the current I1 flowing to the resistance R1, its variation is inversely proportional to R1, as can be seen in <Equation 1>.

Unfortunately, the conventional current generating circuit I1 has a drawback. Since the resistance R1 is formed in a current generating circuit employing device using an active region or polysilicon, the value of R1 varies according to the fabricating process used to a degree of, for example, 10–20%. The output current Iout of the current generating circuit 1 is directly affected by such a variation. That is, if the R1 value is decreased (or increased), the current output Iout increases (or decreases), since the current Iout is inversely proportional to the decreased (or increased) resistance. As a result, the conventional current generating circuit is very sensitive to the resistance variation.

SUMMARY OF THE INVENTION

It is therefore an object of the present invention to provide a current generating circuit which is insensitive to resistance variation.

It is another object of the invention to provide a current generating circuit which generates a constant current, regardless of resistance variation.

In one aspect, the invention is directed to a current generating circuit. The current generating circuit according to the invention includes a first resistance inversely proportional current generator, a second resistance inversely proportional current generator, and a current subtractor. The first resistance inversely proportional current generator has a first resistance element and generates a first current that is inversely proportional to resistance variation of the first resistance element. The second resistance inversely proportional current generator has second and third resistance elements of the same type as the first resistance element and generates a second current that is inversely proportional to half of the resistance variation. The current subtractor subtracts the first current from the second current to generate a constant current regardless of the resistance variation of the first to third resistance elements.

In one embodiment, an intensity or density of the second current is two times larger than an intensity or density of the first current. Also, an intensity of the constant current can be identical to that of the first current.

In one embodiment, the first resistance inversely proportional current generator includes a bandgap reference circuit for generating a predetermined constant current. An operational amplifier has a non-inverse input terminal for receiving a constant voltage from the bandgap reference circuit and an inverse input terminal coupled to one end of the first resistance element and its other end grounded. Firs and second transistors are coupled to form a first current mirror. Third and fourth transistors are coupled to form a second current mirror coupled to the first current mirror. A fifth transistor has a gate for receiving an output of the operational amplifier, a source coupled to the other end of the first resistance element, and a drain coupled to the first current mirror.

In one embodiment, the second resistance inversely proportional current generator includes a first transistor having a source coupled to a power supply voltage through the second resistance element and a grounded gate. A second transistor has its source coupled to a drain of the first transistor and its gate and drain commonly grounded through the third resistance element. A third transistor has its source coupled to the drain of the first transistor, its gate coupled to the gate of the second transistor, and its drain outputs the second current. The first and third transistors constitute a current mirror circuit.

The current subtractor can include transistors constituting a current mirror circuit.

In another aspect, the invention is directed to a constant current supply including a voltage-to-current converter having a first resistance element and converting a constant voltage from a bandgap reference circuit into a first current which is inversely proportional to resistance variation of the first resistance element. The constant current supply includes a second resistance element having one end coupled to a power supply voltage, a first transistor having a source coupled to the other end of the second resistance element and a grounded gate, a second transistor having a source coupled to a drain of the first transistor and a gate and a drain which are interconnected, a third resistance element having one end coupled to the drain of the second transistor and the other end grounded, a third transistor having a source coupled to the drain of the first transistor, a gate coupled to the gate and the drain of the second transistor, and a drain for outputting a second current which is inversely proportional to half of the resistance variation, and a current subtractor subtracting the first current from the second current to output a constant current regardless of resistance variation of the first to third resistances.

In one embodiment, an intensity or density of the second current is two times larger than an intensity or density of the first current, and an intensity or density of the constant current is equal to the intensity density of the first current. The first to third resistance elements can be of the same type.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 2:
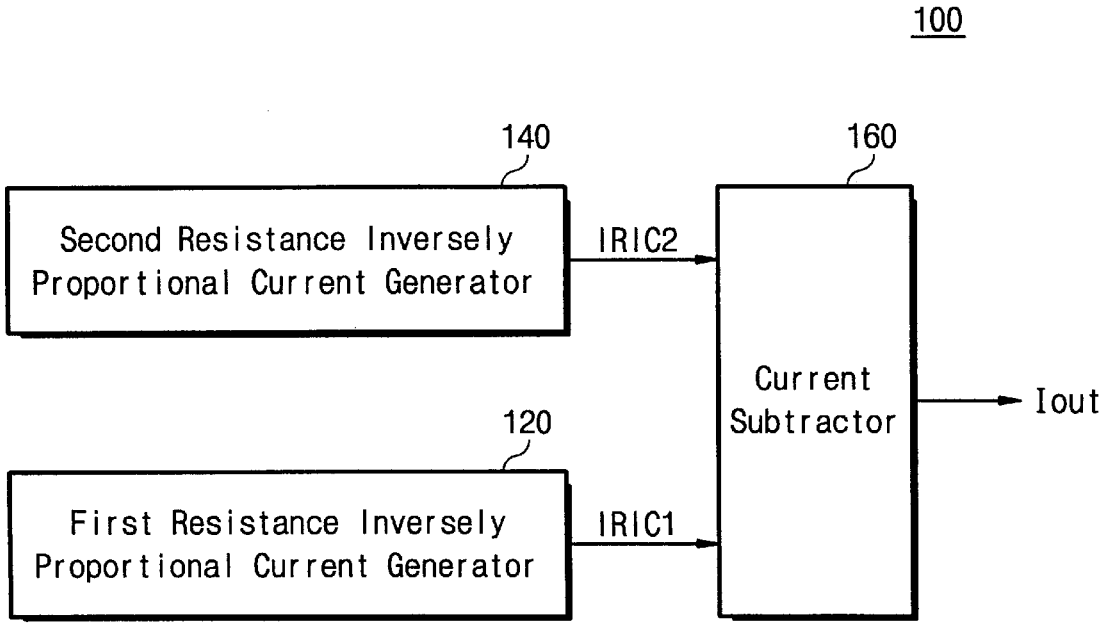
FIG. 2 is a block diagram showing a current generating circuit according to the present invention.
Figure 3:
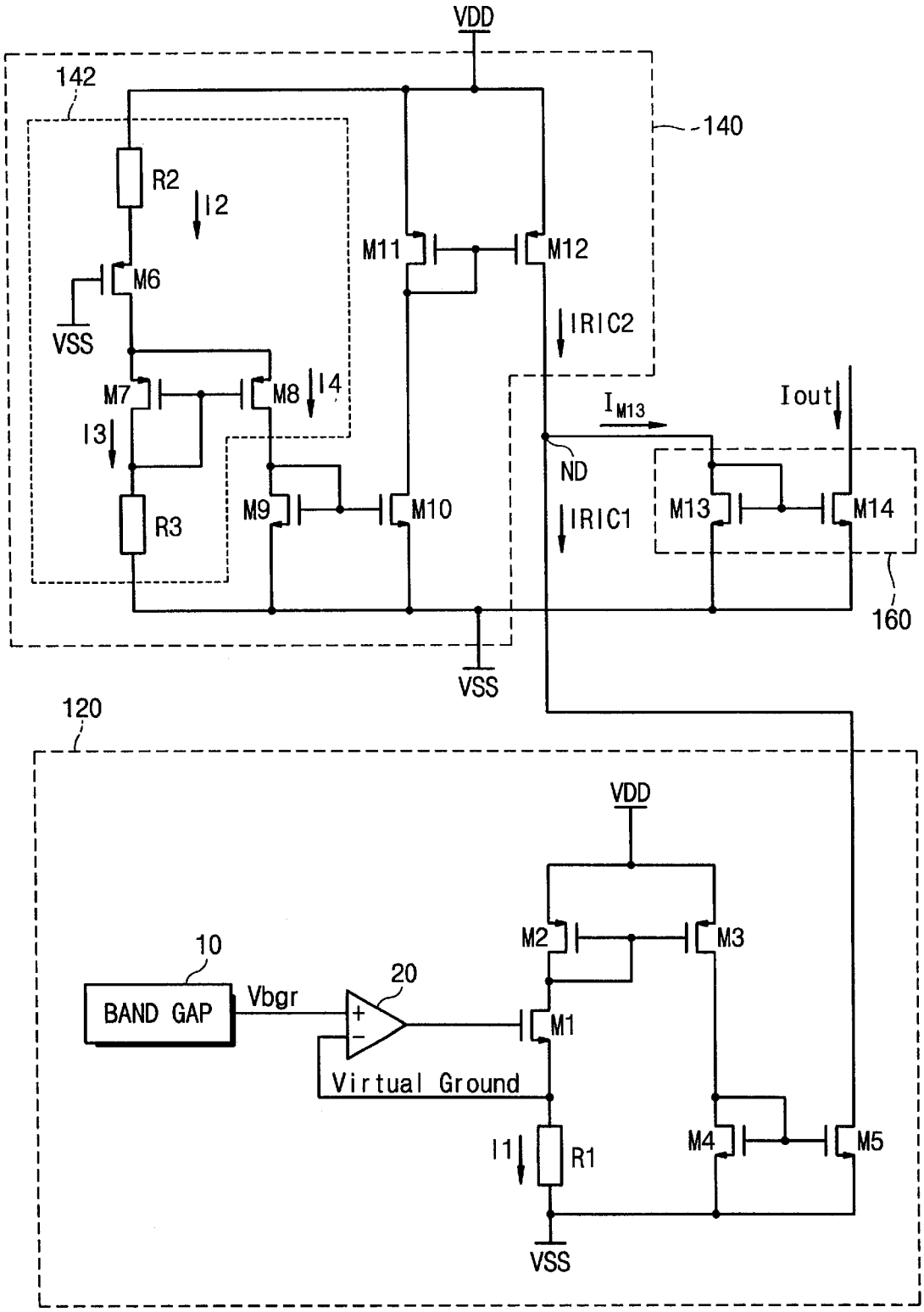
FIG. 3 is a circuit diagram showing one embodiment of a current generating circuit shown in FIG. 2.

A current generating circuit according to the present invention is schematically illustrated in FIG. 2, and a specific embodiment of the current generating circuit of the invention is shown in FIG. 3. The current generating circuit 100 includes a first resistance inversely proportional current generator 120, a second resistance inversely proportional current generator 140, and a current subtractor 160. The first resistance inversely proportional current generator 120 has a resistance element and generates a current IRIC1 that is inversely proportional to resistance variation of the resistant element. The second resistance inversely proportional current generator 140 has resistance elements of the same type (e.g., polysilicon or active region) as the resistance element of the first current generator 120 in order to undergo the same resistance variation as the first current generator 120, and generates a current IRIC2 that is inversely proportional to half of the resistance variation. The current subtractor 160 subtracts the IRIC1 from the IRIC2, finally generating a required current Iout.

Figure 1:
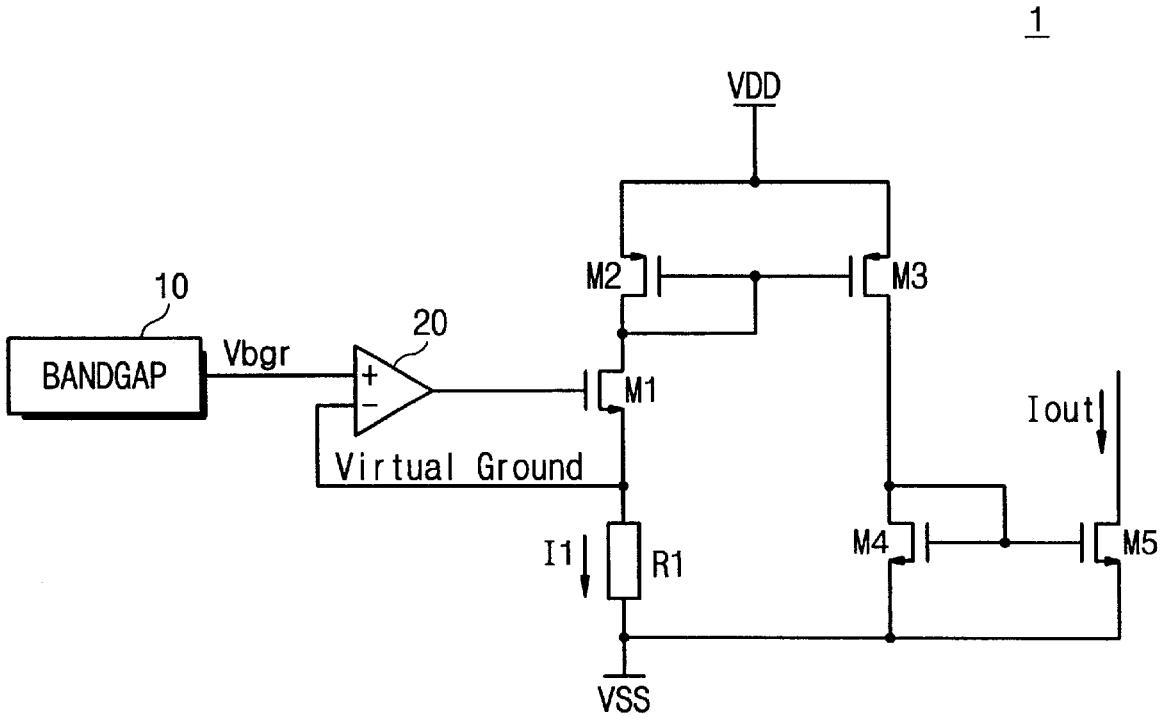
Fig. 1 (Prior Art)
FIG. 1 is a circuit diagram showing a current generating circuit according to the prior art.

Referring now to FIG. 3, a first inversely proportional current generator 120 is coupled to a common node ND, and is composed of a bandgap reference circuit 10, an operational amplifier 20, a resistance R1, two PMOS transistors M2 and M3, and three NMOS transistors M1, M4, and M5. The first resistance inversely proportional current generator 120 has the same construction as in the FIG. 1. That is, when the R1 is varied, a current IRIC1 variation is inversely proportional to the R1 variation.

The second resistance inversely proportional current generator 140 includes a resistance inversely proportional current generator 142, two NMOS transistors M9 and M10 constituting a current mirror circuit, and two PMOS transistors M11 and M12 constituting another current mirror circuit. The resistance inversely proportional current generator 142 is composed of three PMOS transistors M6, M7, and M8 and two resistances R2 and R3. Transistors M7 and M8 constitute a current mirror circuit. Resistances R2 and R3 are made of the same type material (e.g., active region or polysilicon) as the R1 of the first resistance inversely proportional current generator 120. This means that the resistance of R2 and R3 vary equally with the R1 variation. The PMOS transistor M6 operates in the linear region, while the other transistors M7–M12 operate in the saturated region.

One end of R2 is coupled to a power supply voltage VDD, and the other end is coupled to the source of M6, the gate of which is grounded. The source of M7 is coupled to the drain of M6, and the gate and drain of M7 are commonly coupled to one end of R3. The other end of R3 is grounded. The source of M8 is coupled to the drain of M6, the gate of M8 is coupled to the gate of M7, and the drain of M8 outputs a predetermined current $I_{M8}$ to a current mirror circuit composed of transistors M9 and M10. When values of R1–R3 are varied by a fabricating process, the $I_{M8}$ variation is inversely proportional to half of the resistance variation. This will be described more fully hereinbelow.

As described above, transistor M6 operates in the linear region while the others operate in the saturated region. In FIG. 3, a current I2 is equal to the sum of currents I3 and I4. If a wordline W/L of M7 is identical to that of M8, currents I3 and I4 are identical to each other. If a resistance value is increased, a current is decreased. In this case, if the values of R2 and R3 are increased, the current I2 flowing to R2 decreases. Thus, a gate-to-source voltage $V_{GS6}$ of M6 is lowered because a current flowing to M6 must decrease. A voltage $V_{R2}$ applied to the R2 increases, so that the current I2 flowing to R2 increases again. The current decrease resulting from increase in an initial resistance value is suppressed by a negative feedback effect, i.e., the current compensation effect is achieved.

A current I2 is distributed by a W/L ratio of the PMOS transistors M7 and M8. If the W/L ratio is 1:1, a current I2/2 flows through M7 and M8, respectively. Since a gate-to-source voltage VGS7 of M7 is proportional to the square root of a current value, a voltage $V_{GS7}$ is slightly decreased with the current decrease. A voltage of I3×R3 is applied to the resistance R3. By the I2 current decrease and R3 resistance value increase, a varied voltage is applied. Since the I2 current decrease and R3 resistance value increase compensate each other, a constant voltage is maintained. A current mirror formed by M7 and M8 makes a current I4 having an I2/2 value flow. This will now be described more fully hereinbelow.

$$R_{0N6} \cong 1/k(V_{GS6}-Vt) \quad \text{<Equation 2>}$$

wherein, $k=1/2(\mu_o C_{OX})$ $$V_{GS6}=VDD-V_{R2} \quad \text{<Equation 3>}$$

wherein, $V_{R2}=I_2R_2$ $$I_2=Vc/(R_2+R_{oN2}) \quad \text{<Equation 4>}$$

substituting <Equation 3> into <Equation 2>, $$R_{0N6} \cong 1/k(VDD-I_2R_2-Vt) \quad \text{<Equation 5>}$$

substituting <Equation 4> into <Equation 5>, $$I_2=Vc/\{R2+1/k(VDD-I_2R_2-Vt)\} \quad \text{<Equation 6>}$$

<Equation 6> is ordered with respect to $I_2$ as follows:

$$I_2R_2^2k-I_2\{I+R_2k(Vc+VDD-Vt)+Vck(VDD-Vt)=0 \quad \text{<Equation 7>}$$

<Equation 7> is ordered with respect to $I_2$ as follows:

$$I_2=[1+R_2k\alpha\pm\{(1+R_2k\alpha)^2-4R_2^2k^2\beta\}^{1/2}]/2R_2^2k \quad \text{<Equation 8>}$$

wherein, $\alpha=Vc+VDD-Vt$, $\beta=Vc(VDD-Vt)$

Since the "k" value is very small, a value in the square root of <Equation 8> cannot be "1". Therefore, the I2 current value is represented as follows:

$$I_2 \cong (2+R_2k\alpha)/2R_2^2k \text{ or } R_2k\alpha/2R_2^2k \quad \text{<Equation 9>}$$

If denominator and numerator in <Equation 9> are divided by "k", it is represented as follows:

<Equation 10>

$$I_2 \cong (2/k+R_2\alpha)/2R_2^2 \quad (1) \text{ or}$$

$$R_2k\alpha/2R_2^2 \quad (2)$$

wherein, (1) is not valid because the I2 value is much greater than the 2/k value. Therefore, the I2 value is equal to (2), which is ordered as follows:

$$I_2 \cong R_2\alpha/2R_2^2=\alpha/2R_2^2 \quad \text{<Equation 11>}$$

In order to find out the current variation with resistance value variation, <Equation 11> is partially differentiated with respect to R2, as follows:

$$d1/dR_2 \cong -2\alpha/4R_2^2=-(\alpha/2R_2^2)=-(Vc+VDD-Vt)/2R_2^2 \quad \text{<Equation 12>}$$

$$d1/dR_1=-V_{BGR}/R_1^2 \quad \text{<Equation 13>}$$

The <Equation 13> is a partial derivative result with respect to a resistance in order to determine an amount of the current variation with the resistance variation. Comparing <Equation 12> with <Equation 13>, it is determined that the current variation amount is equal to half of a conventional change amount because the voltage $V_{BGR}$ and "Vc+VDD−Vt" are constants.

Referring to FIG. 3, a current subtractor 160 is coupled to the common node ND, and is composed of NMOS transistors M13 and M14 that are coupled to form a current mirror circuit. The current subtractor 160 subtracts a current IRIC1 created by the first resistance inversely proportional current generator 120 from a current IRIC2 created by the second resistance inversely proportional current generator 140, generating a required current Iout=IRIC2−IRIC1.

In the circuit operation, assuming that the current IRIC1 intensity is equal to the Iout current intensity (IRIC1=Iout) and the current IRIC2 intensity is two times larger than the current Iout intensity (IRIC2=2Iout), if each value of the resistances R1–R3 is decreased in the fabricating process, the IRIC1 is inversely proportional to the resistance variation (Δ) to be increased. Since the resistance R2 and R3 of the second resistance inversely proportional current generator 140 are varied equally to the resistance R1 of the first resistance inversely proportional current generator 120, IRIC2 is inversely proportional to half of the resistance variation (Δ/2) to be increased. A current $I_{M13}$ flowing to the NMOS transistor M13 becomes the current Iout, which is represented as follows:

$$I_{M13}=IRIC2-IRIC1$$

$$I_{M13}=2I\text{out}(1+66\ /2)-I\text{out}(1+\Delta)$$

$$I_{M13}=I_{OUT} \quad \text{<Equation 14>}$$

Figure 4:
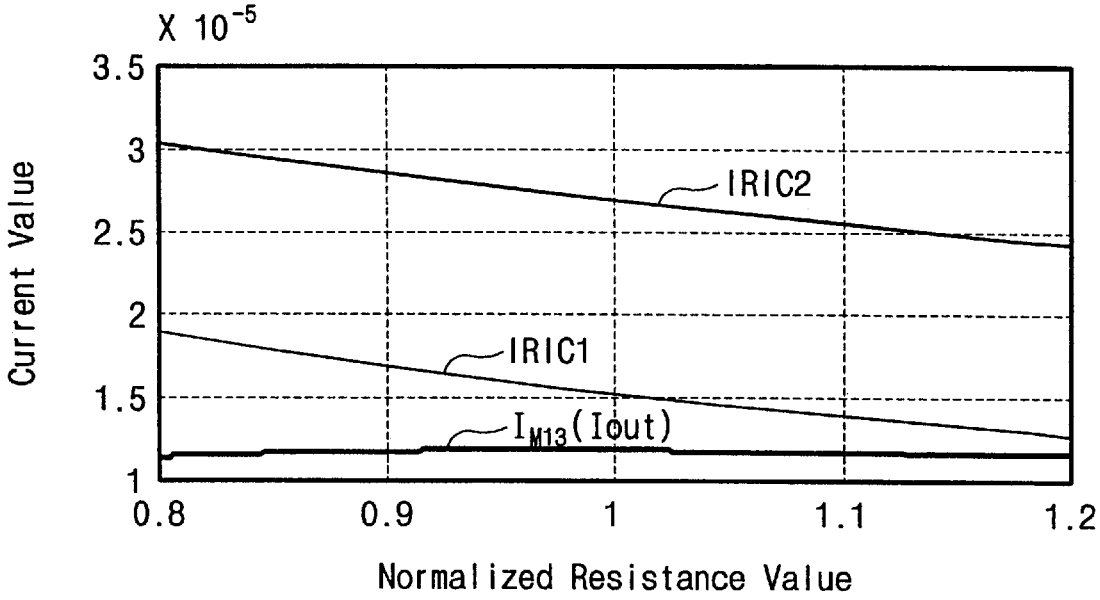
FIG. 4 is a graph showing a relationship between a normalized resistance value and an output current.
Figure 4:
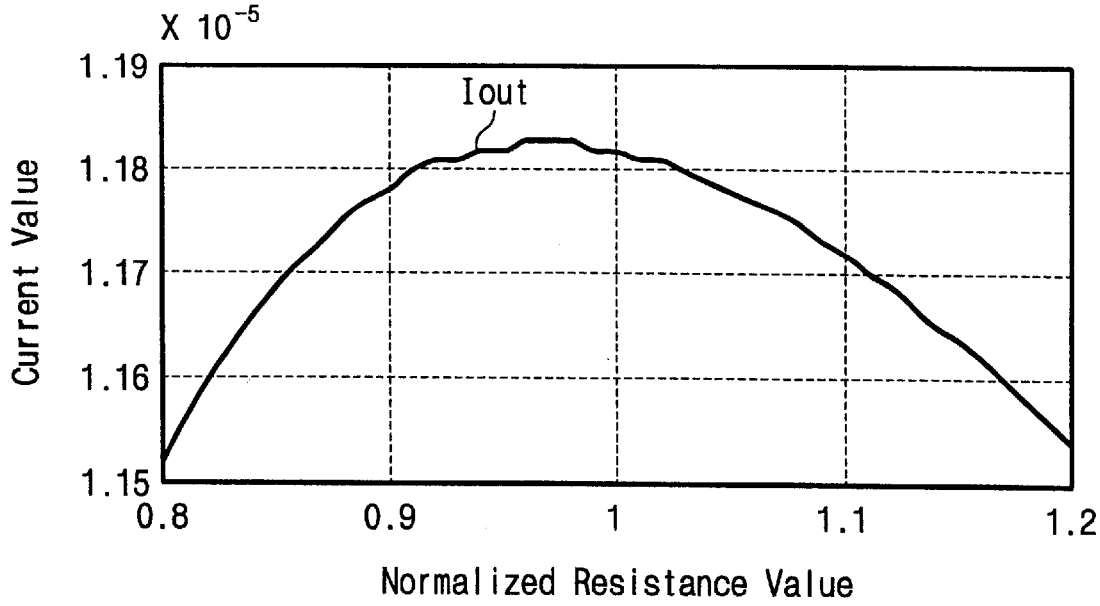

The current IRIC1 variation is offset by IRIC2. That is, as can be seen from <Equation 2>, although aim values of the resistances R1–R3 are varied in a fabricating process, a constant current Iout can be obtained regardless of the resistance variation, as shown in FIG. 4.

As described thus far, a variation amount of a current generated from a second resistance inversely proportional current generator is half-decreased when a resistance value is varied in a fabricating process. As a result, a constant current can be obtained regardless of the resistance variation.

Although the present invention has been described and illustrated in detail, it is clearly understood that the same is by way of illustration and example only and is not to be taken by way of limitation, the sprit and scope of the present invention being limited only by the terms of the appended claims.

What is claimed is:

1. A current generating circuit comprising:

a first resistance inversely proportional current generator having a first resistance element, the first resistance inversely proportional current generator generating a first current which is inversely proportional to a resistance variation of the first resistance element;

a second resistance inversely proportional current generator having second and third resistance elements of the same type as the first resistance element, the second resistance inversely proportional current generator generating a second current which is inversely proportional to half of the resistance variation; and a current subtractor subtracting the first current from the second current to output a constant current regardless of variation of the first to third resistance elements.

2. The current generating circuit as claimed in claim 1, wherein a density of the second current is two times larger than a density of the first current, and a density of the constant current is equal to the density of the first current.

3. The current generating circuit as claimed in claim 1, wherein the first resistance inversely proportional current generator includes:

a bandgap reference circuit generating a predetermined constant current;

an operational amplifier having a non-inverse input terminal for receiving a constant voltage from the bandgap reference circuit and an inverse input terminal coupled to one end of the first resistance element, another end of the first resistance element being grounded;

first and second transistors coupled to form a first current mirror;

third and fourth transistors coupled to form a second current mirror coupled to the first current mirror; and a fifth transistor having a gate for receiving an output of the operational amplifier, a source coupled to the other end of the first resistance element, and a drain coupled to the first current mirror.

4. The current generating circuit as claimed in claim 1, wherein the second resistance inversely proportional current generator includes:

a first transistor having a source coupled to a power supply voltage through the second resistance element and a grounded gate;

a second transistor having a source coupled to a drain of the first transistor and a gate and a drain which are commonly grounded through the third resistance element; and a third transistor having a source coupled to the drain of the first transistor, a gate coupled to the gate of the second transistor, and a drain for outputting the second current, wherein the first and third transistors constitute a current mirror circuit.

5. The current generating circuit as claimed in claim 1, wherein the current subtractor is composed of transistors constituting a current mirror circuit.

6. A constant current supply including a voltage-to-current converter having a first resistance element and converting a constant voltage from a bandgap reference circuit into a first current which is inversely proportional to resistance variation of the first resistance element, the constant current supply comprising:

a second resistance element having one end coupled to a power supply voltage;

a first transistor having a source coupled to the other end of the second resistance element and a grounded gate;

a second transistor having a source coupled to a drain of the first transistor, and a gate and a drain which are interconnected;

a third resistance element having one end coupled to the drain of the second transistor and the other end grounded;

a third transistor having a source coupled to the drain of the first transistor, a gate coupled to the gate and the drain of the second transistor, and a drain for outputting a second current which is inversely proportional to half of the resistance variation; and a current subtractor subtracting the first current from the second current to output a constant current regardless of resistance variation of the first to third resistances.

7. The constant current supply as claimed in claim 6, wherein an intensity of the second current is two times larger than an intensity of the first current, and an intensity of the constant current is equal to the intensity of the first current.

8. The constant current supply as claimed in claim 6, wherein the first to third resistance elements are of the same type.

* * * * *